US010626697B2

(12) United States Patent
Dirocco

(10) Patent No.: US 10,626,697 B2
(45) Date of Patent: Apr. 21, 2020

(54) FRAC PLUG WITH BI-DIRECTIONAL GRIPPING ELEMENTS

(71) Applicant: FORUM US, INC., Houston, TX (US)

(72) Inventor: Robert Dirocco, Humble, TX (US)

(73) Assignee: FORUM US, INC., Houston, TX (US)

( * ) Notice: Subject to any disclaimer, the term of this patent is extended or adjusted under 35 U.S.C. 154(b) by 14 days.

(21) Appl. No.: 16/119,423

(22) Filed: Aug. 31, 2018

(65) Prior Publication Data

US 2020/0072020 A1 Mar. 5, 2020

(51) Int. Cl.
*E21B 33/129* (2006.01)
*E21B 33/128* (2006.01)

(52) U.S. Cl.
CPC ..... *E21B 33/1293* (2013.01); *E21B 33/128* (2013.01)

(58) Field of Classification Search
CPC ..... E21B 33/129–12955; E21B 33/134
See application file for complete search history.

(56) References Cited

U.S. PATENT DOCUMENTS

| | | | |
|---|---|---|---|
| 2,230,712 | A | 2/1941 | Bendeler et al. |
| 3,343,607 | A | 9/1967 | Current |
| 4,436,150 | A | 3/1984 | Barker |
| 6,167,963 | B1 | 1/2001 | McMahan et al. |
| 6,491,116 | B2 | 12/2002 | Berscheidt et al. |
| 7,735,549 | B1 | 6/2010 | Nish et al. |
| 7,740,079 | B2 | 6/2010 | Clayton et al. |
| 8,079,413 | B2 | 12/2011 | Frazier |
| 8,267,177 | B1 | 9/2012 | Vogel et al. |
| 9,169,704 | B2 | 10/2015 | Dockweiler et al. |
| 9,759,034 | B2 | 9/2017 | King et al. |
| 9,777,551 | B2 | 10/2017 | Davies et al. |
| 9,835,003 | B2 | 12/2017 | Harris et al. |
| 2011/0240295 | A1 | 10/2011 | Porter et al. |

(Continued)

FOREIGN PATENT DOCUMENTS

| | | | |
|---|---|---|---|
| WO | 2016028311 | A1 | 2/2016 |
| WO | 2016044597 | A1 | 3/2016 |

(Continued)

OTHER PUBLICATIONS

International Search Report and Written Opinion dated Feb. 26, 2019, corresponding to Application No. PCT/US2018/060803.

(Continued)

*Primary Examiner* — Giovanna C Wright
(74) *Attorney, Agent, or Firm* — Patterson + Sheridan, LLP

(57) ABSTRACT

A frac plug for use in a wellbore includes an upper mandrel with an axis extending therethrough and a lower mandrel that moves axially along the axis and towards the upper mandrel. The frac plug further includes a sealing element and a grip ring that move radially outward from the axis and into engagement with the wellbore. The grip ring includes a first gripping element positioned at a first rake angle with respect to the axis to prevent upward movement of the grip ring with respect to the wellbore when in gripping engagement with the wellbore, and a second gripping element positioned at a second rake angle with respect to the axis that is different from the first rake angle to prevent downward movement of the grip ring with respect to the wellbore when in gripping engagement with the wellbore.

18 Claims, 7 Drawing Sheets

(56) References Cited

U.S. PATENT DOCUMENTS

| | | | | |
|---|---|---|---|---|
| 2013/0186648 | A1 | 7/2013 | Xu et al. | |
| 2015/0010797 | A1 | 1/2015 | Kim | |
| 2015/0013965 | A1 | 1/2015 | Cox et al. | |
| 2015/0129242 | A1 | 5/2015 | Farquhar | |
| 2015/0300121 | A1 | 10/2015 | Xu | |
| 2016/0138387 | A1 | 5/2016 | Xu et al. | |
| 2016/0305215 | A1 | 10/2016 | Harris et al. | |
| 2016/0312555 | A1 | 10/2016 | Xu et al. | |
| 2016/0376869 | A1 | 12/2016 | Rochen et al. | |
| 2017/0260824 | A1* | 9/2017 | Kellner | B22F 7/06 |
| 2017/0370176 | A1* | 12/2017 | Frazier | E21B 33/1212 |
| 2018/0266204 | A1 | 9/2018 | Sherlin | |
| 2018/0363409 | A1* | 12/2018 | Frazier | E21B 33/1285 |

FOREIGN PATENT DOCUMENTS

| | | | |
|---|---|---|---|
| WO | 2016210161 | A1 | 12/2016 |
| WO | 2017044298 | A1 | 3/2017 |

OTHER PUBLICATIONS

International Search Report and Written Opinion dated May 28, 2019, corresponding to Application No. PCT/US2018/064973.
International Invitation to Pay Additional Fees dated Apr. 3, 2019, corresponding to Application No. PCT/US2018/064973.

* cited by examiner

FRAC PLUG WITH BI-DIRECTIONAL GRIPPING ELEMENTS

BACKGROUND

Field

Embodiments of the present disclosure relate to plugs that may be used within the production of oil and gas, and more particularly to non-retrievable plugs used to isolate a portion of a well.

Description of the Related Art

Fracturing plugs or "frac plugs" are designed to set, seal, and isolate inside a wellbore to divide a well into one or more zones. After the frac plug is set, the plug may be used as a one way valve that allows fluid flow in one direction and not the other. For example, the wellbore may hold higher pressure above the frac plug, but when the pressure is released, the wellbore returns to equilibrium. Casing of the wellbore is perforated in one of the zones, and the formation surrounding the perforation is fractured using hydraulic pressure that is supplied through the wellbore to stimulate the formation. After the pressure is released and the stimulation is complete, the perforations in the casing and fractures in the formation allow the flow of oil and gas to enter the wellbore and be recovered to the surface. After the fracturing and stimulation operation is complete, the frac plug is drilled out to allow access to the full bore of the wellbore for subsequent operations.

Frac plugs create a seal inside of the wellbore, such as by axially squeezing a seal element located between two members on a body of the frac plug. Further, frac plugs set inside the wellbore by having slip assemblies move outward to grip a wall of the wellbore. Further still, frac plugs may have long axial lengths, which increases the amount of drilling needed to drill out the frac plugs to have access to the full bore of the wellbore as described above.

Therefore, there exists a need for new and/or improved frac plugs.

SUMMARY

Embodiments of the present disclosure relate to plugs and methods that may be utilized in the oil and gas industry, such as related to non-retrievable plugs used to isolate a portion of a well.

In one embodiment, a frac plug for use in a wellbore is disclosed. The frac plug includes an upper mandrel with an axis extending therethrough and a lower mandrel that moves axially along the axis and towards the upper mandrel. The frac plug further includes a sealing element that moves radially outward from the axis and into sealing engagement with the wellbore, and a grip ring positioned between the upper mandrel and the lower mandrel that moves radially outward from the axis and into gripping engagement with the wellbore as the lower mandrel moves axially towards the upper mandrel. The grip ring includes a first gripping element positioned at a first rake angle with respect to the axis to prevent upward movement of the grip ring with respect to the wellbore when in gripping engagement with the wellbore, and a second gripping element positioned at a second rake angle with respect to the axis that is different from the first rake angle to prevent downward movement of the grip ring with respect to the wellbore when in gripping engagement with the wellbore.

In one embodiment, a frac plug for use in a wellbore is disclosed. The frac plug includes an upper mandrel with an axis extending therethrough and a lower mandrel that moves axially along the axis and towards the upper mandrel. The frac plug further includes a sealing element that moves radially outward from the axis and into sealing engagement with the wellbore, and a grip ring positioned between the upper mandrel and the lower mandrel that moves radially outward from the axis. The grip ring includes a single ring body, a first button positioned within the ring body at a first rake angle with respect to the axis, and a second button positioned within the ring body at a second rake angle with respect to the axis that is different from the first rake angle.

In another embodiment, a method of setting a frac plug within a wellbore is disclosed. The method includes lowering the frac plug into the wellbore, moving a grip ring radially outward with respect to an axis of the frac plug such that a first gripping element positioned at a first rake angle and a second gripping element positioned at a second rake angle that is different from the first rake angle grippingly engage the wellbore, and moving a sealing element radially outward with respect to the axis of the frac plug such that the sealing element sealingly engages the wellbore.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the present disclosure relate to a fracturing plug or "frac plug" used to isolate a portion of a well in the production of oil and gas, and more particularly a non-retrievable frac plug. The frac plug includes an upper mandrel with an axis extending therethrough and a lower mandrel movable axially along the axis and towards the upper mandrel. A sealing element is included with the frac plug and is movable radially outward from the axis and into sealing engagement with a wellbore. A grip ring is also included with the frac plug and is positioned between the upper mandrel and the lower mandrel. The grip ring is movable radially outward from the axis and into gripping engagement with the wellbore, such as when the lower mandrel moves axially towards the upper mandrel.

The grip ring includes a first gripping element, such as a first button, positioned at a first rake angle with respect to the axis and a second gripping element, such as a second button, positioned at a second rake angle with respect to the axis that is different from the first rake angle. The first gripping element is used to prevent upward movement of the grip ring with respect to the wellbore when in gripping engagement with the wellbore, such as to prevent movement of the frac plug when pressure or force is applied from below the frac plug. The second gripping element is used to prevent downward movement of the grip ring with respect to the wellbore when in gripping engagement with the wellbore, such as to prevent movement of the frac plug when pressure or force is applied from above the frac plug. In the embodiment in which the gripping elements include buttons, the second button may be larger in diameter than the first button, and the buttons may extend substantially the same height out from the grip ring.

Figure 1:
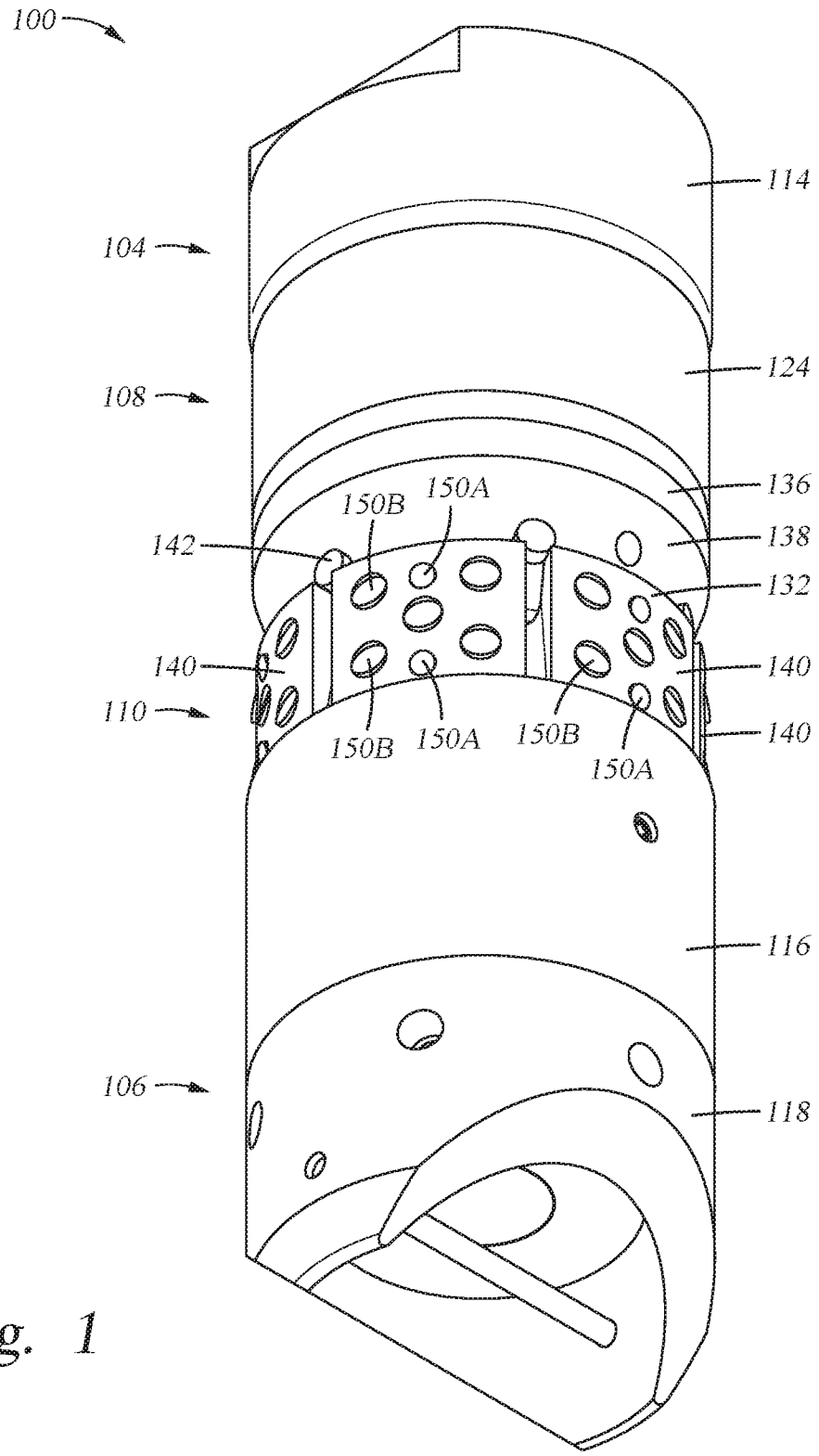
FIG. 1 is a below perspective view of a frac plug in accordance with one or more embodiments of the present disclosure.
Figure 2:
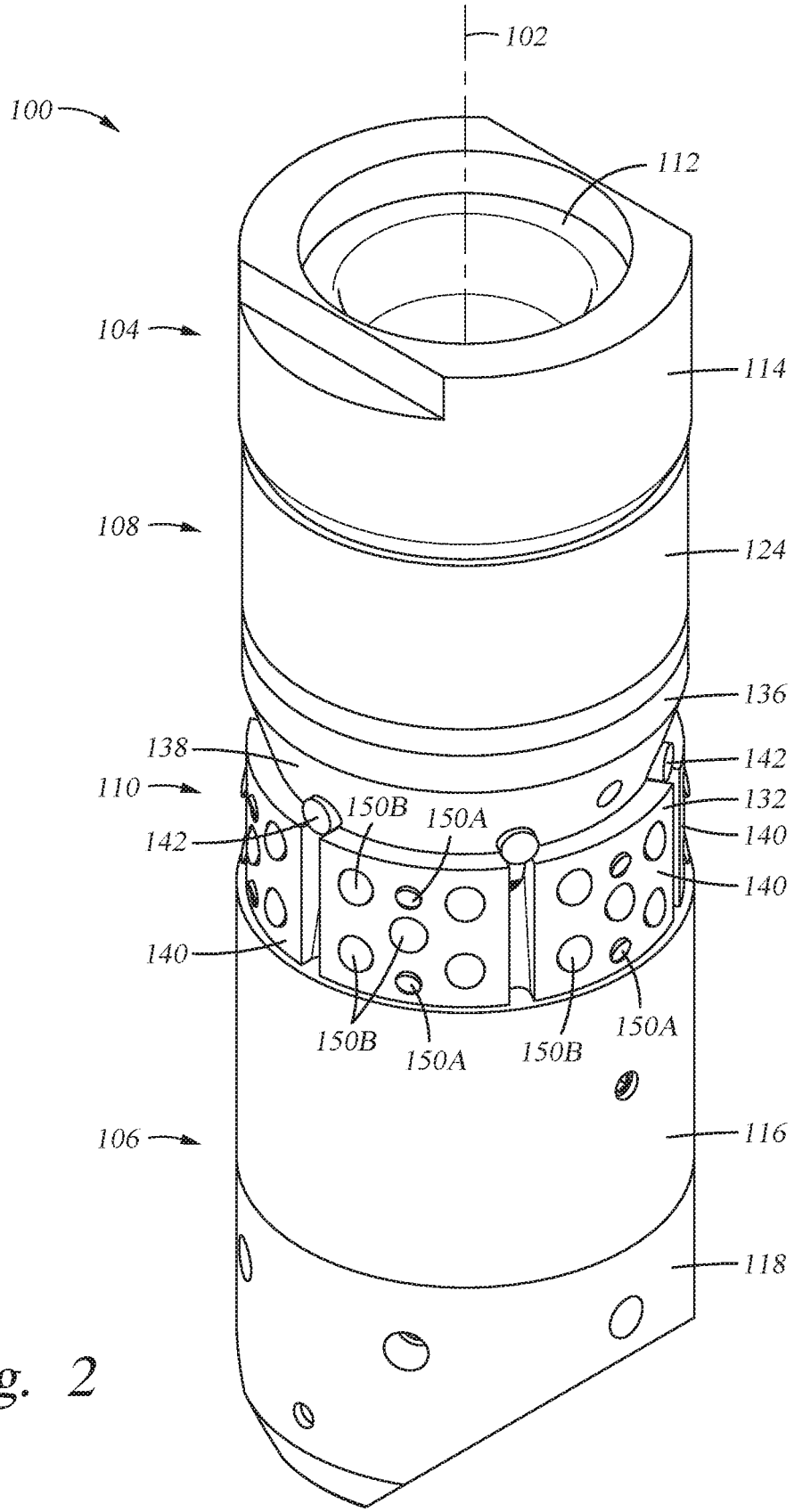
FIG. 2 is an above perspective view of the frac plug in accordance with one or more embodiments of the present disclosure.
Figure 3:
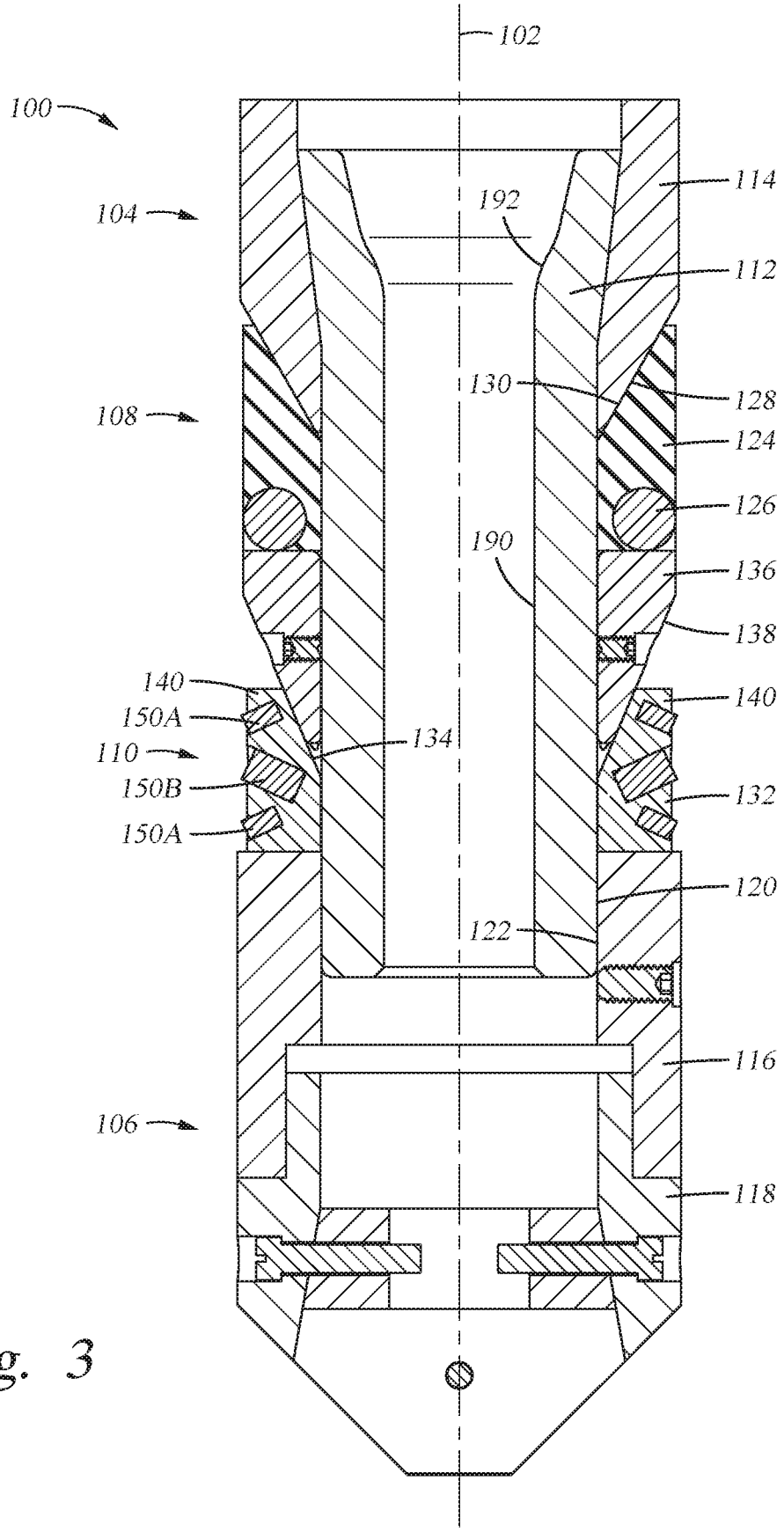
FIG. 3 is a cross-sectional view of the frac plug in accordance with one or more embodiments of the present disclosure.
Figure 4:
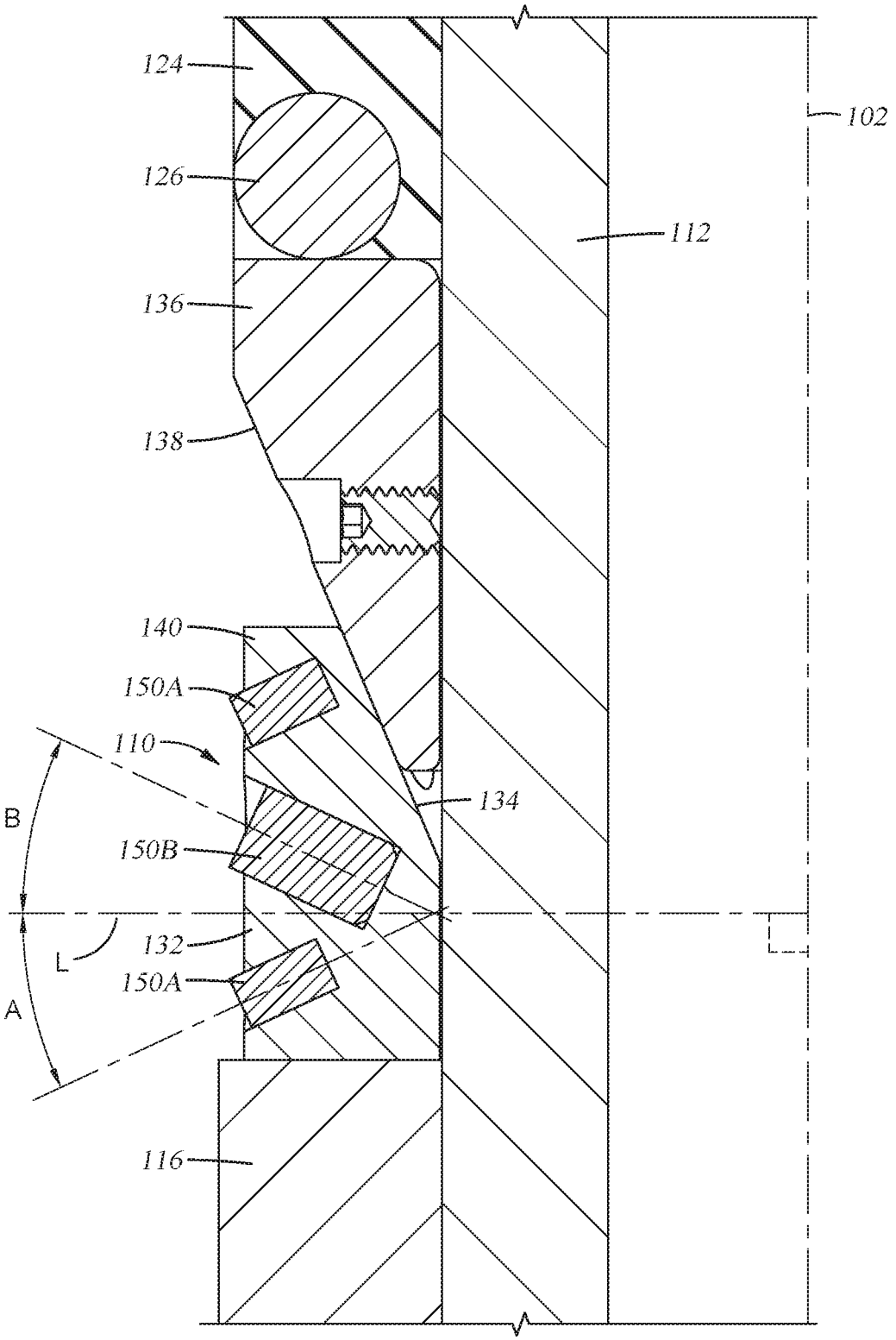
FIG. 4 is a detailed cross-sectional view of a grip ring of the frac plug in accordance with one or more embodiments of the present disclosure.

FIGS. 1-4 provide multiple views of a frac plug 100 in accordance with one or more embodiments of the present disclosure. In particular, FIG. 1 is a below perspective view of the frac plug 100, FIG. 2 is an above perspective view of the frac plug 100, FIG. 3 is a cross-sectional view of the frac plug 100, and FIG. 4 is a detailed cross-sectional view of a grip ring 110 of the frac plug 100.

The frac plug 100 includes an upper mandrel 104 and a lower mandrel 106 and is defined about an axis 102. The axis 102 extends through the center of the upper mandrel 104 and the lower mandrel 106. The upper mandrel 104 and the lower mandrel 106 are axially movable towards each other along the axis 102. The frac plug 100 further includes a sealing element 108 and a grip ring 110. The sealing element 108 moves radially outward from the axis 102 and into sealing engagement with a wellbore. For example, the sealing element 108 may move radially outward from the axis 102 and into sealing engagement with the wellbore when the upper mandrel 104 and the lower mandrel 106 move axially towards each other. Further, the grip ring 110 also moves radially outward from the axis 102 and into gripping engagement with the wellbore. For example, the grip ring 110 may move radially outward from the axis 102 and into gripping engagement with the wellbore when the upper mandrel 104 and the lower mandrel 106 move axially towards each other. The wellbore is cased, as discussed and shown below, but may be uncased and an open hole wellbore, may be in a vertical orientation, and/or may be in a horizontal orientation.

The upper mandrel 104 and/or the lower mandrel 106 may each be formed from one or more components. As best shown in FIG. 3 for example, the upper mandrel 104 may include an inner housing 112 and a cap 114 with the inner housing 112 positioned within and coupled to the cap 114. Further, the lower mandrel 106 includes an outer housing 116 and a guide shoe 118 with the guide shoe 108 positioned within and coupled to an inner surface of the outer housing 116. An engagement interface, such as a friction or interference-fit interface, is formed or positioned between an outer surface 120 of the inner housing 112 of the upper mandrel 104, and an inner surface 122 of the outer housing 116 of the lower mandrel 106. The engagement interface enables the upper mandrel 104 and the lower mandrel 106 to move axially towards each other, but prevents the upper mandrel 104 and the lower mandrel 106 from moving axially away from each other. Thus, as the upper mandrel 104 and the lower mandrel 106 move axially towards each other, the position of the upper mandrel 104 and the lower mandrel 106 may be maintained with respect to each other when force is no longer applied to move the upper mandrel 104 and the lower mandrel 106 axially towards each other.

A flow bore 190 is formed through the frac plug 100 about the axis 102 to enable fluid flow through the frac plug 100, such as when in an unset position and a set position as further described below. A ball seat 192 is also included within the frac plug 100, such as formed within the inner housing 112, to receive a ball. When the ball seat 192 receives the ball, fluid flow is prevented through the flow bore 190. A setting tool, as shown and discussed more below, is received through the flow bore 190 to also move the frac plug 100 from the unset position to the set position.

The sealing element 108 is shown positioned between the upper mandrel 104 and the lower mandrel 106, such as positioned on the outer surface 120 of the inner housing 112 of the upper mandrel 104. The sealing element 108 includes a body 124 that may be formed out of a polymeric or elastomeric material to facilitate sealing engagement with the wellbore. A biasing member 126, such as a spring, may be positioned within the body 124 to bias the sealing element 108 radially inward towards upper mandrel 104. The sealing element 108, and more specifically the body 124, includes a tapered inner surface 128, and the cap 114 includes a tapered outer surface 130. The tapered inner surface 128 and the tapered outer surface 130 are engageable with each other to move the sealing element 108 radially outward from the axis 102. When the upper mandrel 104 and the lower mandrel 106 move axially towards each other, the tapered inner surface 128 of the sealing element 108 moves along the tapered outer surface 130 of the cap 114, thereby pushing and moving the sealing element 108 radially outward from the axis 102.

The grip ring 110 is positioned between the upper mandrel 104 and the lower mandrel 106, such as positioned above the outer housing 116 of the lower mandrel 106. The grip ring 110 includes a ring body 132 with a tapered inner surface 134 formed on the ring body 132. A cone 136 is positioned between the upper mandrel 104 and the lower mandrel 106, such as positioned on the outer surface 120 of the inner housing 112 of the upper mandrel 104. The cone 136 may also be axially movable between the upper mandrel 104 and the lower mandrel 106 and include a tapered outer surface 138. The tapered inner surface 134 of the grip ring 110 is engageable with the tapered outer surface 138 of the cone 136 to move the grip ring 110 radially outward from the axis 102. In particular, when the upper mandrel 104 and the lower mandrel 106 move axially towards each other, the tapered inner surface 134 of the grip ring 110 moves along the tapered outer surface 138 of the cone 136, thereby pushing and moving the grip ring 110 radially outward from the axis 102.

Further, the ring body 132 of the grip ring 110 is formed as a single ring body prior to expansion that may be able to separate into two or more segments 140, such as when expanding and moving radially outward from the axis 102. One or more pins 142 are positioned within the cone 136 between the segments 140 of the ring body 132. As the grip ring 110 moves radially outward, the segments 140 separate from each other, and the pins 142 may be used to facilitate guiding the segments 140 along the tapered outer surface 138 of the cone 136.

Referring still to FIGS. 1-4, the grip ring 110 includes multiple gripping elements 150A and 150B positioned at multiple rake angles, such as to prevent upward and downward movement of the grip ring 110 and the frac plug 100 when the grip ring 110 is in gripping engagement with the wellbore. In particular, as best shown in FIG. 4, the grip ring 110 includes a first gripping element 150A positioned at a first rake angle A with respect to the axis 102, and includes a second gripping element 150B positioned at a second rake angle B with respect to the axis 102. The grip ring 110 is in gripping engagement with the wellbore when the gripping elements 150A and 150B bite into and grip the wellbore (or casing of the wellbore). The first gripping element 150A is used to prevent upward movement of the grip ring 110 and the frac plug 100 along the axis 102 with respect to the wellbore. The second gripping element 150B is used to prevent downward movement of the grip ring 110 and the frac plug 100 along the axis 102 with respect to the wellbore.

The rake angle may be measured from horizontal, such as from a line L perpendicular with respect to the axis 102 shown in FIG. 4. The first rake angle A for the first gripping element 150A may be between about −5 degrees and about −30 degrees with respect to the axis 102, and may more specifically be about −15 degrees. The second rake angle B for the second gripping element 150B may be between about 5 degrees and about 30 degrees with respect to the axis 102, and may more specifically be about 15 degrees. In one or more embodiments, the first rake angle A and the second rake angle B may have the same absolute value (e.g., −15 degrees for the first rake angle A and 15 degrees for the second rake angle B). However, the first rake angle A and the second rake angle B may have different signs (e.g., the first rake angle A is negative and the second rake angle B is positive) for the first rake angle A and the second rake angle B to be different. The first rake angle A and the second rake angle B are, thus, different from each other for the purposes of preventing upward and downward movement of the frac plug 100, and even more so may be symmetric and opposite each other with respect to the line (identified as reference lines L in FIG. 4) that is perpendicular with respect to the axis 102.

Further, the gripping elements 150A and 150B included with the grip ring 110 are shown as buttons positioned within the ring body 132. The first gripping element 150A is a first button positioned within the ring body 132 of the grip ring 110, and the second gripping element 150B is a second button positioned within the ring body 132 of the grip ring 110. The second button is shown as having a larger diameter than the first button. As the frac plug 100 may be exposed to different forces from above and below, the second button being larger than the first button may facilitate the second button being exposed to larger forces than the first button. The gripping elements 150A and 150B, and more specifically the buttons, also extend substantially the same height above the ring body 132 of the grip ring 110 such that the gripping elements 150A and 150B grippingly engage the wellbore at the same time when move radially outward. Further, though the gripping elements 150A and 150B are shown as buttons, other gripping elements, such as slips and/or teeth alone or in combination with buttons, may be included within the grip ring 110 without departing from the scope of the present disclosure.

The grip ring 110 may also include more than one first gripping element 150A, in that more than one gripping element 150A may be included in the grip ring 110 that is positioned at the first rake angle A. Further, the grip ring 110 may include more than one second gripping element 150B, in that more than one gripping element 150B may be included in the grip ring 110 that is positioned at the second rake angle B.

In such an embodiment, two or more first gripping elements 150A may be positioned within axial alignment (e.g., at the same axial position along the axis 102) with respect to each other, as shown best in FIGS. 1 and 2. Two or more first gripping elements 150A may also be equally distributed about the axis 102 with respect to each other, as shown best in FIGS. 1 and 2. Further, two or more of the first gripping elements 150A may be positioned within circumferential alignment (e.g., at the same circumferential position with respect to the axis 102) with respect to each other, as shown best in FIGS. 1 and 2. Similarly, two or more of the second gripping elements 150B may be positioned within axial alignment with respect to each other, as shown best in FIGS. 1 and 2. Two or more of the second gripping elements 150B may be equally distributed about the axis 102 with respect to each other, as shown best in FIGS. 1 and 2. Further, two or more of the second gripping elements 150B may be positioned within circumferential alignment with respect to each other, as shown best in FIGS. 1 and 2.

The first gripping elements 150A and the second gripping elements 150B may also be arranged or positioned between each other, such as in axial alignment and/or circumferential alignment with respect to each other. For example, as shown in FIG. 4, the first gripping elements 150A and the second gripping element 150B are in circumferential alignment with respect to each other with the second gripping element 150B positioned between the first gripping elements 150A. The first gripping elements 150A are also shown as positioned circumferentially within a center of the segments 140 of the grip ring 110.

Figure 5:
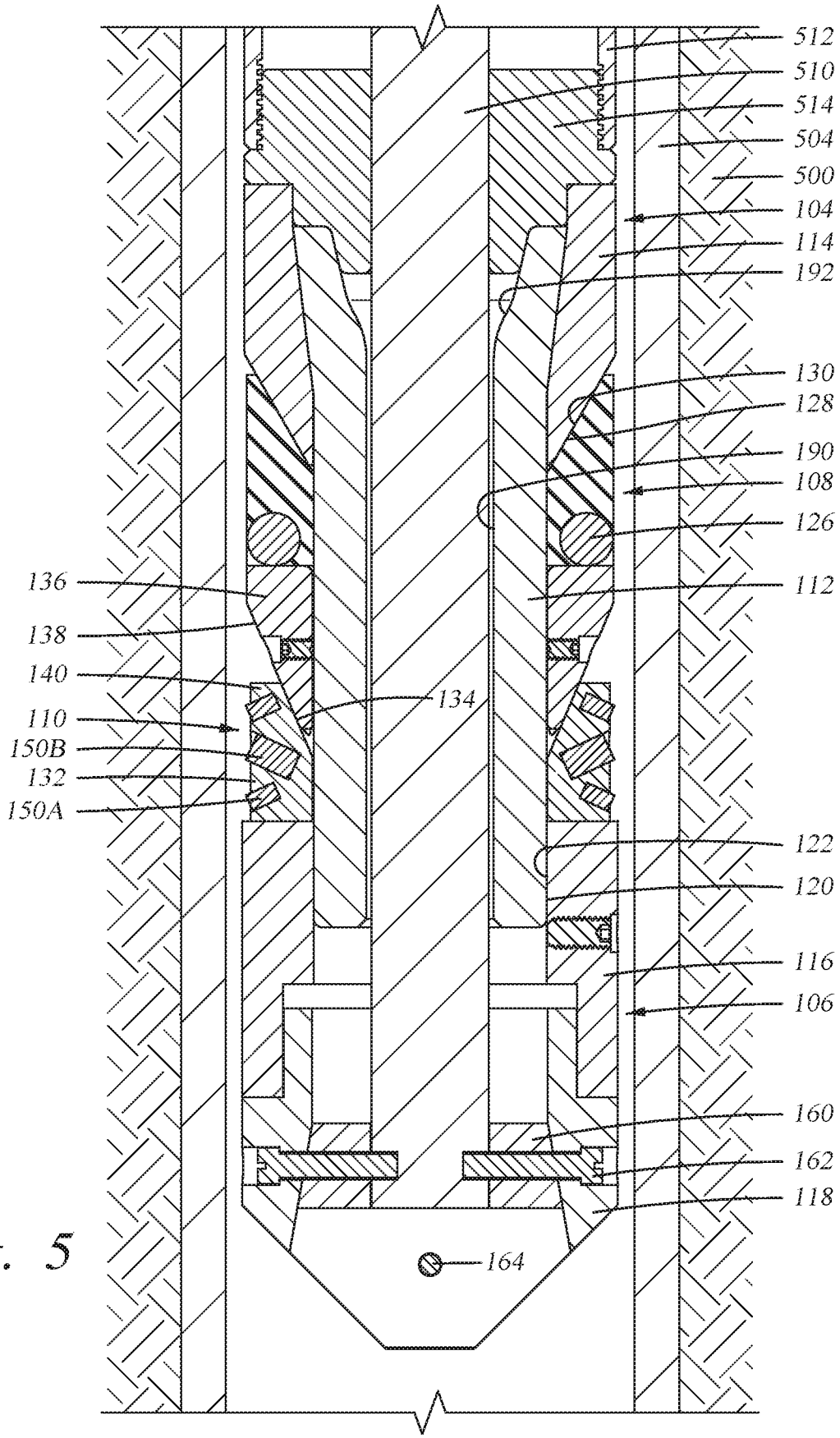
FIG. 5 is a cross-sectional view of the frac plug in an unset position in accordance with one or more embodiments of the present disclosure.
Figure 6:
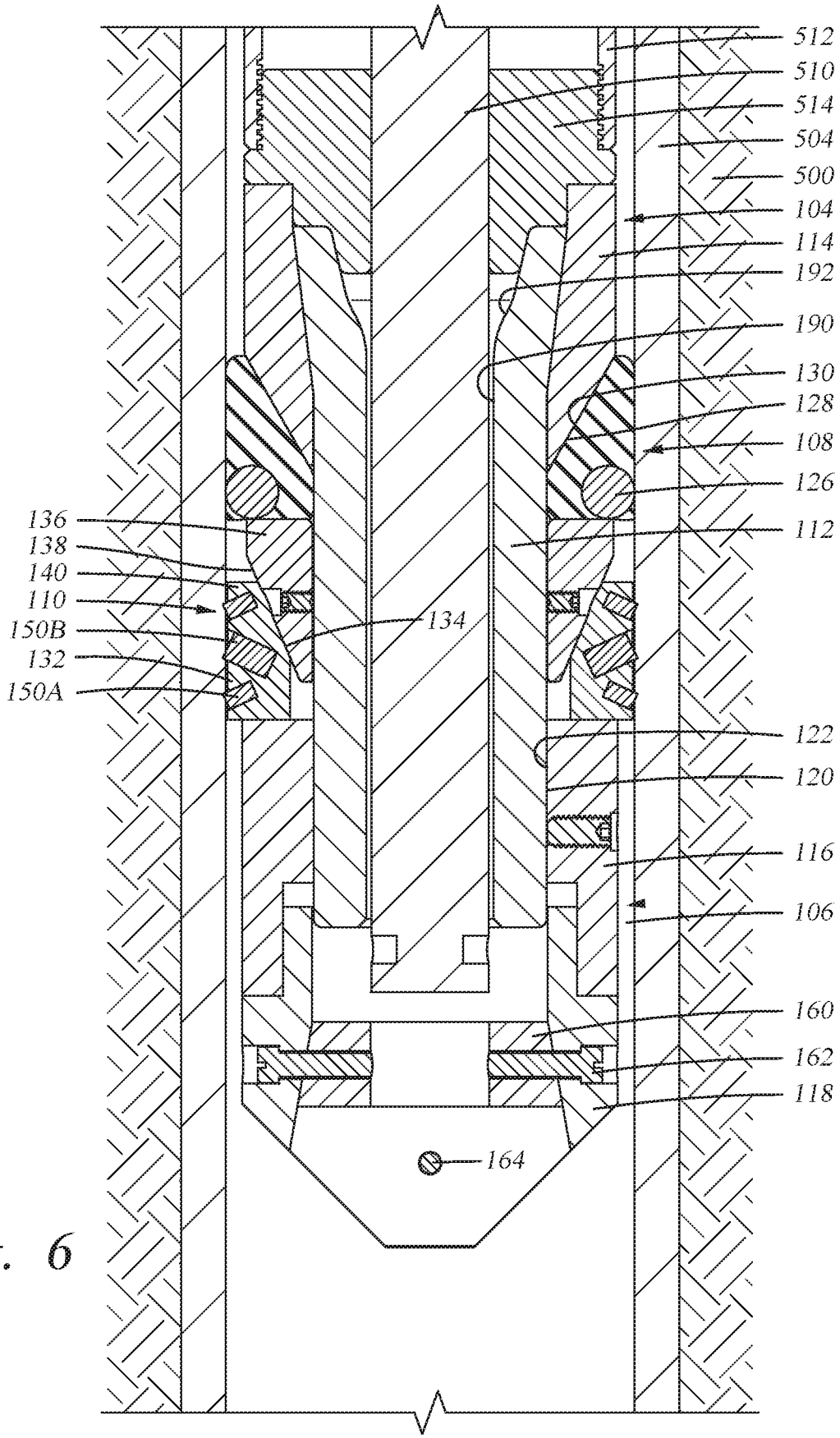
FIG. 6 is a cross-sectional view of the frac plug in a set position in accordance with one or more embodiments of the present disclosure.
Figure 7:
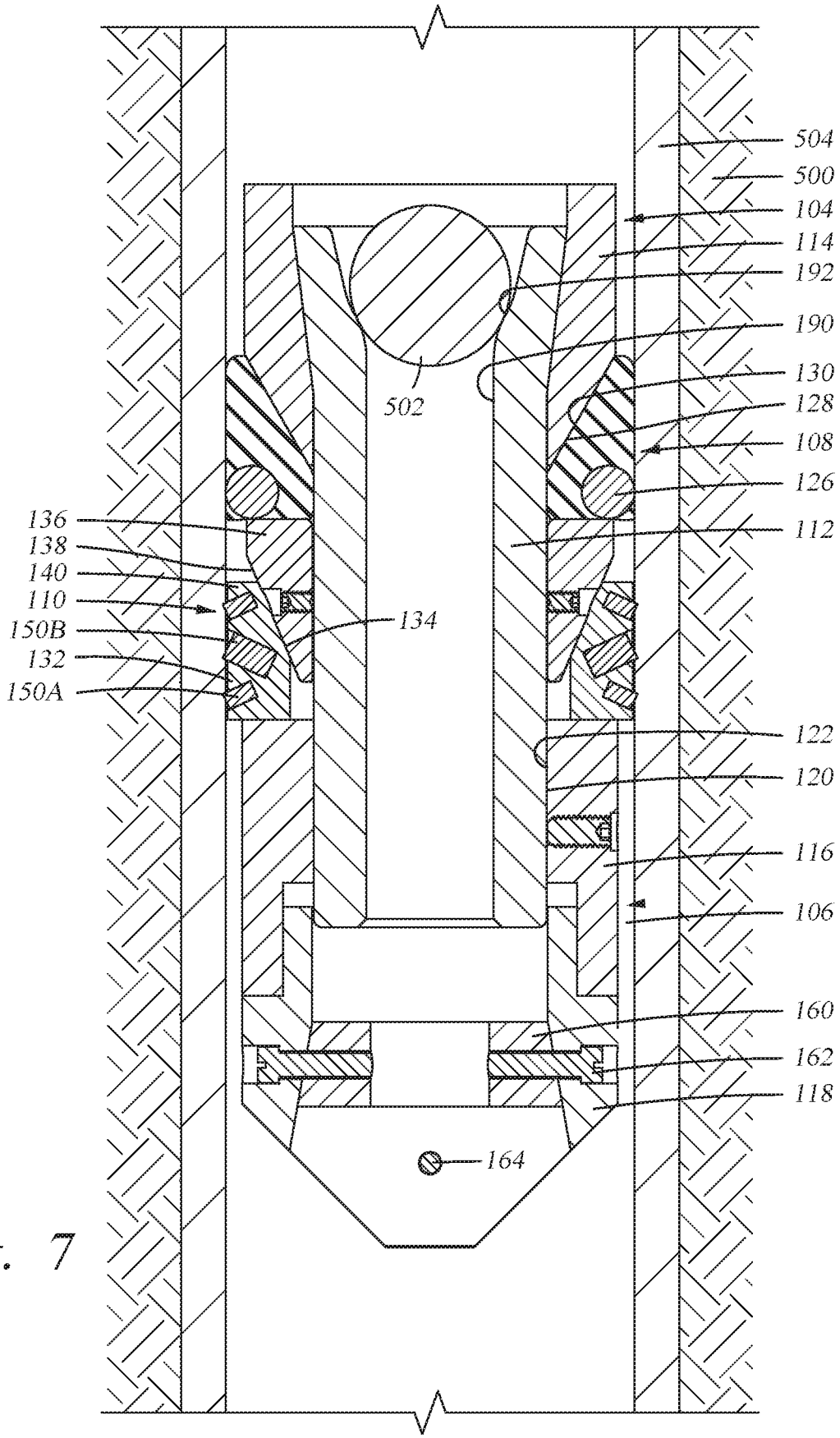
FIG. 7 is a cross-sectional view of a ball received within the frac plug in accordance with one or more embodiments of the present disclosure.

FIGS. 5-7 provide multiple cross-sectional views of the frac plug 100 in a wellbore 500 moving from an unset position to a set position in accordance with one or more embodiments of the present disclosure. FIG. 5 shows the frac plug 100 in the unset position, FIG. 6 shows the frac plug 100 in the set position, and FIG. 7 shows the frac plug 100 in the set position with a ball 502 received within the ball seat 192 of the frac plug 100. Further, the wellbore 500 includes a casing 504 with the frac plug 100 lowered with respect to the casing 504 and moved from the unset position to the set position to form a seal against the casing 504. A setting tool is also partially shown in FIGS. 5 and 6 to move the frac plug 100 from the unset position to the set position, in which the setting tool includes an inner mandrel 510, an outer mandrel 512, and an adapter 514 that engages the upper mandrel 104 of the frac plug 100.

To move the frac plug 100 from the set position to the unset position, the setting tool is used to apply tension or a lifting force to move the lower mandrel 106 towards the upper mandrel 104. The frac plug 100 is shown as including a shear cap 160 coupled to the lower mandrel 106, and more particularly to the guide shoe 118. The shear cap 160 is coupled to the guide shoe 118 through one or more shear pins 162. The inner mandrel 510 of the setting tool is positioned through the flow bore 190 of the frac plug 100 and is coupled to the lower mandrel 106 through the shear pins 162. The lower mandrel 106 then moves from a lower position (shown in the unset position in FIG. 5) to an upper position (shown in the set position in FIG. 6) with respect to the upper mandrel 104 through the force applied by the inner mandrel 510.

The axial tensile force, also referred to as a setting force, is applied by the inner mandrel 510 to the lower mandrel 106 with the outer mandrel 512 and the adapter 514 providing a counter-force to the upper mandrel 104 to set the frac plug 100. The force applied by the inner mandrel 510 moves the lower mandrel 106 axially towards the upper mandrel 104 from the lower position to the upper position. Further, this force is transmitted from the lower mandrel 106 to the grip ring 110, the cone 136, and the sealing element 108.

As the lower mandrel 106 moves from the lower position to the upper position, the tapered inner surface 128 of the sealing element 108 moves along the tapered outer surface 130 of the cap 114, thereby pushing and moving the sealing element 108 radially outward from a disengaged sealing position (shown in the unset position in FIG. 5) to an engaged sealing position (shown in the set position in FIG. 6). In the disengaged sealing position, the sealing element 108 is not sealingly engaged with the wellbore 500, or more specifically the casing 504 (if included), and in the engaged sealing position, the sealing element 108 is sealingly engaged with the wellbore 500.

Further, as the lower mandrel 106 moves from the lower position to the upper position, the tapered inner surface 134 of the grip ring 110 moves along the tapered outer surface 138 of the cone 136, thereby pushing and moving the grip ring 110 radially outward from a disengaged gripping position (shown in the unset position in FIG. 5) to an engaged gripping position (shown in the set position in FIG. 6). In the disengaged gripping position, the grip ring 110 is not grippingly engaged with the casing 504, and in the engaged gripping position, the grip ring 110 is grippingly engaged with the wellbore 500. Accordingly, when the lower mandrel 106 is in the lower position and the frac plug 100 is in the unset position, the sealing element 108 is in the disengaged sealing position and the grip ring 110 is in the disengaged gripping position. When the lower mandrel 106 is in the upper position and the frac plug 100 is in the set position, the sealing element 108 is in the engaged sealing position and the grip ring 110 is in the engaged gripping position.

With the frac plug 100 in the set position, the sealing element 108 forms a seal between the frac-plug 100 and the casing 504, and the grip ring 110 grips the casing 504. The frac plug 100 may maintain the set position through the engagement interface formed between the outer surface 120 of the inner housing 112 of the upper mandrel 104, and the inner surface 122 of the outer housing 116 of the lower mandrel 106. The axial pull force is then further applied by the inner mandrel 510 until the shear pins 162 shear, as shown in FIG. 6, which releases the inner mandrel 510 of the setting tool from the frac plug 100. This allows the setting tool to be removed from the wellbore 500, in which case fluid may flow through the frac plug 100. Then, as shown in FIG. 7, the ball 502 may be deployed to come into engagement with the ball seat 192 and prevent fluid flow through the frac plug 100. When the ball 502 has been deployed, pressure within the casing 405, such as from above the frac plug 100 may be increased to conduct a fracturing or stimulation operation with the wellbore 500. A pin 164 may also be included within the lower mandrel 106, such as positioned within the shear cap 160, to prevent the shear cap 160 from exiting below the frac plug 100 or from a ball entering into the frac plug 100 from below.

When set in the wellbore, the frac plug 100 is exposed to upward and downward forces, such as from fluid pressure applied to the frac plug 100. Fluid pressure in the wellbore 500 from above the frac plug 100 applies a downward force to the frac plug 100, particularly with the ball 502 received within the frac plug 100. Thus, to prevent downward movement of the frac plug 100 within the wellbore 500, the second gripping elements 150B of the frac plug 100 provide gripping engagement to oppose the downward force on the frac plug 100. Further, fluid pressure in the wellbore 500 from below the frac plug 100 may apply an upward force to the frac plug 100, such as when receiving backflow through the wellbore 500. The inner diameter of the flow bore 190 through the frac plug 100 restricts fluid flow through the frac plug 100, such as with respect to the wellbore 500, which increases the upward force applied to the frac plug 100. Thus, to prevent upward movement of the frac plug 100 within the wellbore 500, the first gripping elements 150A of the frac plug 100 provide gripping engagement to oppose the upward force on the frac plug 100.

The frac plug 100 is made from or includes one or more materials that are drillable and have a low specific gravity, such as composite materials, plastics, rubbers, and fiberglass. In particular, materials that have a low specific gravity facilitate removal of the frac plug 100 from the wellbore 500 (such as through pumping) after being drilled. Composite material may include a carbon fiber reinforced material or other material that has high strength, a low specific gravity, and yet is easily drillable. The upper mandrel 104, the lower mandrel 106, the cone 136, and the body 132 of the grip ring 110 may be made from a composite material. Further, if using buttons for the gripping elements 150A and 150B of the grip ring 110, the buttons may be used to lower the specific gravity of the grip ring 110, as opposed to forming the grip ring 110 from metal, and more specifically cast iron. For example, a grip ring 110 formed from cast iron may have a specific gravity of about 7 or higher. A grip ring 110 formed using buttons, as discussed above, may have a body 132 formed from a material having a specific gravity of less than about 2, such as about 1.6, and the buttons may have a specific gravity less than the cast iron, such as about 6 or lower. Accordingly, a grip ring 110 in accordance with the present disclosure may have a lower overall specific gravity to facilitate removal of the grip ring 110 from the wellbore 500 after being drilled.

The use of directional terms such as above, below, upper, lower, upward, downward, left, right, uphole, downhole and the like are used in relation to the illustrative embodiments as depicted in the figures, the upward direction being toward the top of the corresponding figure and the downward direction being toward the bottom of the corresponding figure, the uphole direction being toward the surface of the well and the downhole direction being toward the toe of the well. Further, as used herein, the term "about" encompasses +/−5% of each numerical value. For example, if the numerical value is "about 80%," then it can be 80%+/−5%, equivalent to 76% to 84%. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While the foregoing is directed to embodiments of the present disclosure, other and further embodiments of the present disclosure thus may be devised without departing from the basic scope thereof, and the scope thereof is determined by the claims that follow.

The invention claimed is:

1. A frac plug, comprising:

an upper mandrel comprising an axis extending therethrough;

a lower mandrel configured to move axially along the axis and towards the upper mandrel, wherein the lower mandrel is configured to move towards the upper mandrel from a lower position to an upper position;

a sealing element configured to move radially outward from the axis and into sealing engagement with a wellbore, wherein the sealing element is configured to move radially outward from the axis from a disengaged sealing position when the lower mandrel is in the lower position to an engaged sealing position when the lower mandrel is in the upper position; and a grip ring positioned between the upper mandrel and the lower mandrel and configured to move radially outward from the axis and into gripping engagement with the wellbore as the lower mandrel moves axially towards the upper mandrel, wherein the grip ring is configured to move radially outward from the axis from a disengaged gripping position when the lower mandrel is in the lower position to an engaged gripping position when the lower mandrel is in the upper position, wherein the grip ring comprises:

a first gripping element positioned at a first rake angle with respect to the axis to prevent upward movement of the grip ring with respect to the wellbore when in gripping engagement with the wellbore; and a second gripping element positioned at a second rake angle with respect to the axis that is different from the first rake angle to prevent downward movement of the grip ring with respect to the wellbore when in gripping engagement with the wellbore.

2. The frac plug of claim 1, wherein:

the first gripping element comprises a first plurality of gripping elements in axial alignment with each other and equally distributed about the axis; and the second gripping element comprises a second plurality of gripping elements in axial alignment with each other and equally distributed about the axis.

3. The frac plug of claim 1, wherein:

the second gripping element is positioned between two first gripping elements.

4. The frac plug of claim 1, wherein:

the grip ring comprises a ring body;

the first gripping element comprises a first button positioned within the ring body of the grip ring;

the second gripping element comprises a second button positioned within the ring body of the grip ring; and the second button is larger in diameter than the first button.

5. The frac plug of claim 1, wherein the first gripping element and the second gripping element extend substantially the same height above a ring body of the grip ring.

6. The frac plug of claim 1, wherein the grip ring comprises a ring body that is configured to separate into a plurality of segments when the grip ring moves radially outward from the axis.

7. The frac plug of claim 1, wherein:

the first rake angle of the first gripping element is between about −5 degrees and about −30 degrees; and the second rake angle of the second gripping element is between about 5 degrees and about 30 degrees.

8. A frac plug, comprising:

an upper mandrel comprising an axis extending therethrough, an inner housing, and a cap coupled to the inner housing;

a lower mandrel configured to move axially along the axis and towards the upper mandrel;

a sealing element positioned between the upper mandrel and the lower mandrel and configured to move radially outward from the axis and into sealing engagement with a wellbore, the cap comprising a tapered outer surface and the sealing element comprising a tapered inner surface with the tapered inner surface of the sealing element configured to move along the tapered outer surface of the cap for the sealing element to move radially outward from the axis; and a grip ring positioned between the upper mandrel and the lower mandrel and configured to move radially outward from the axis and into gripping engagement with the wellbore as the lower mandrel moves axially towards the upper mandrel, wherein the grip ring comprises:

a first gripping element positioned at a first rake angle with respect to the axis to prevent upward movement of the grip ring with respect to the wellbore when in gripping engagement with the wellbore; and a second gripping element positioned at a second rake angle with respect to the axis that is different from the first rake angle to prevent downward movement of the grip ring with respect to the wellbore when in gripping engagement with the wellbore.

9. A frac plug, comprising:

an upper mandrel comprising an axis extending therethrough;

a lower mandrel configured to move axially along the axis and towards the upper mandrel;

a sealing element configured to move radially outward from the axis and into sealing engagement with a wellbore;

a grip ring positioned between the upper mandrel and the lower mandrel and configured to move radially outward from the axis and into gripping engagement with the wellbore as the lower mandrel moves axially towards the upper mandrel, wherein the grip ring comprises:

a first gripping element positioned at a first rake angle with respect to the axis to prevent upward movement of the grip ring with respect to the wellbore when in gripping engagement with the wellbore; and a second gripping element positioned at a second rake angle with respect to the axis that is different from the first rake angle to prevent downward movement of the grip ring with respect to the wellbore when in gripping engagement with the wellbore; and a cone positioned between the upper mandrel and the lower mandrel, wherein the cone comprises a tapered outer surface and the grip ring comprises a tapered inner surface with the tapered inner surface of the grip ring configured to move along the tapered outer surface of the cone for the grip ring to move radially outward from the axis.

10. A frac plug, comprising:

an upper mandrel comprising an axis extending therethrough;

a lower mandrel configured to move axially along the axis and towards the upper mandrel;

a sealing element configured to move radially outward from the axis and into sealing engagement with a wellbore;

a grip ring positioned between the upper mandrel and the lower mandrel and configured to move radially outward from the axis and into gripping engagement with the wellbore as the lower mandrel moves axially towards the upper mandrel, wherein the grip ring comprises:

a first gripping element positioned at a first rake angle with respect to the axis to prevent upward movement of the grip ring with respect to the wellbore when in gripping engagement with the wellbore; and a second gripping element positioned at a second rake angle with respect to the axis that is different from the first rake angle to prevent downward movement of the grip ring with respect to the wellbore when in gripping engagement with the wellbore; and an engagement interface positioned between the upper mandrel and the lower mandrel to enable the upper mandrel and the lower mandrel to move axially towards each other and prevent the upper mandrel and the lower mandrel from moving axially away each other.

11. The frac plug of claim 10, wherein:

the upper mandrel comprises an inner housing positioned within and coupled to a cap;

the lower mandrel comprises a guide shoe positioned within and coupled to an outer housing; and the engagement interface is formed between the inner housing and the outer housing.

12. A frac plug, comprising:

an upper mandrel comprising an axis extending therethrough;

a lower mandrel configured to move axially along the axis and towards the upper mandrel, wherein the lower mandrel is configured to move towards the upper mandrel from a lower position to an upper position;

a sealing element configured to move radially outward from the axis, wherein the sealing element is configured to move radially outward from the axis from a disengaged sealing position when the lower mandrel is in the lower position to an engaged sealing position when the lower mandrel is in the upper position; and a grip ring positioned between the upper mandrel and the lower mandrel and configured to move radially outward from the axis, wherein the grip ring is configured to move radially outward from the axis from a disengaged gripping position when the lower mandrel is in the lower position to an engaged gripping position when the lower mandrel is in the upper position, the grip ring comprising:

a single ring body;

a first button positioned within the single ring body at a first rake angle with respect to the axis; and a second button positioned within the single ring body at a second rake angle with respect to the axis that is different from the first rake angle.

13. The frac plug of claim 12, wherein:

the second button is larger in diameter than the first button; and the first button and the second button extend substantially the same height above the single ring body of the grip ring.

14. The frac plug of claim 12, wherein:

the first button comprises a first plurality of buttons in axial alignment with each other and equally distributed about the axis; and the second button comprises a second plurality of buttons in axial alignment with each other and equally distributed about the axis.

15. The frac plug of claim 12, wherein the second button is positioned between two first buttons.

16. A method of setting a frac plug within a wellbore, comprising:

lowering the frac plug into the wellbore, the frac plug comprising an upper mandrel comprising an axis extending therethrough, and a lower mandrel;

moving the lower mandrel axially along the axis and towards the upper mandrel from a lower position to an upper position;

moving a grip ring radially outward with respect to an axis of the frac plug from a disengaged gripping position when the lower mandrel is in the lower position to an engaged gripping position when the lower mandrel is in the upper position such that a first gripping element positioned at a first rake angle and a second gripping element positioned at a second rake angle that is different from the first rake angle grippingly engage the wellbore; and moving a sealing element radially outward with respect to the axis of the frac plug from a disengaged sealing position when the lower mandrel is in the lower position to an engaged sealing position when the lower mandrel is in the upper position such that the sealing element sealingly engages the wellbore.

17. The method of claim 16, further comprising:

applying an upward force to the frac plug;

preventing upward movement of the frac plug within the wellbore through the gripping engagement of the first gripping element with the wellbore;

applying a downward force to the frac plug; and preventing downward movement of the frac plug within the wellbore through the gripping engagement of the second gripping element with the wellbore.

18. The method of claim 16, wherein:

the grip ring comprises a ring body;

the first gripping element comprises a first button positioned within the ring body of the grip ring;

the second gripping element comprises a second button positioned within the ring body of the grip ring; and the second button is larger in diameter than the first button.

* * * * *